US005965838A

United States Patent [19]

Boswell et al.

[11] Patent Number: 5,965,838

[45] **Date of Patent: *Oct. 12, 1999**

[54] FLAT-SIDED WARHEAD

[75] Inventors: George T. Boswell, Springfield, Va.; William G. Rueb, Washington, D.C.

[73] Assignee: The United States of America as represented by the Secretary of the Army, Washington, D.C.

[ * ] Notice: This patent is subject to a terminal disclaimer.

[21] Appl. No.: 05/556,258

[22] Filed: Mar. 13, 1975

[51] Int. Cl.[6] ..... F42B 12/22

[52] U.S. Cl. ..... 102/475; 102/492; 102/493; 102/494

[58] Field of Search ..... 102/67, DIG. 2, 102/475, 491–495, 305

[56] References Cited

U.S. PATENT DOCUMENTS

| | | | |
|---|---|---|---|
| 2,948,218 | 8/1960 | Pearson et al. | 102/67 |
| 3,136,251 | 6/1964 | Witow | 102/67 |
| 3,386,380 | 6/1968 | Francis | 102/23 |
| 3,613,586 | 10/1971 | Talley et al. | 102/67 |
| 3,731,633 | 5/1973 | Davis | 102/67 |
| 3,757,694 | 9/1973 | Talley et al. | 102/67 |
| 3,853,066 | 12/1974 | Weeding | 102/67 |

*Primary Examiner*—Harold J. Tudor
*Attorney, Agent, or Firm*—Saul Elbaum; Freda Krosnick; Frank J. Dynda

[57] ABSTRACT

A warhead for use in air defense missiles has a flat-sided cross-sectional configuration which can be mass focused to direct an entire side onto a target. The warhead may be rotated about the missile longitudinal axis to properly orient a warhead side at the time of detonation.

3 Claims, 2 Drawing Sheets

FLAT-SIDED WARHEAD

RIGHTS OF THE GOVERNMENT

The invention described herein may be manufactured, used, and licensed by or for the United States Government for governmental purposes without the payment to us of any royalty thereon.

BACKGROUND OF THE INVENTION

The present invention relates to warheads for use in air defense missiles and, more particularly to improvements in fragmenting warheads whereby the on-target fragment density is significantly increased without increasing warhead mass.

Conventional missile warheads are annular in cross section. When the charge is fired the fragments are distributed with substantially uniform density radially outward from the longitudinal axis of the missile. Assuming that firing occurs at the optimum time during the missile-target encounter, the probability of a target being hit by a warhead fragment depends upon the mass of the warhead, the size of the target, and the distance between the missile and target. Referring to FIG. 1 by way of illustration, a target 1 having an eight foot cross-sectional diameter is shown in an encounter with a missile warhead 2 having an eight inch cross-sectional diameter. The maximum permissible spacing between target 1 and missile 2 at the moment of firing is assumed to be eighty feet. Imaginary lines A and B are drawn from the longitudinal axis of warhead 2 to the top and bottom, respectively, of target 1. The angle 2$\alpha$ subtended between lines A and B corresponds to the angular portion of warhead 2 from which fragments are directed toward the target. For the dimensions assumed in FIG. 1, angle 2$\alpha$ turns out to be 5.72°. Since there are 360° of fragmenting warhead surface, and the fragment density is uniform in all directions about the missile axis, the percentage of warhead fragments which hit target 1 is $$\frac{5.72}{360} \times 100 = 1.6\%.$$

This extremely small percentage considerably limits the target hit probability and therefore places considerable demands on the missile guidance system to bring the missile sufficiently close to the target to considerably increase hit angle 2$\alpha$. Alternatively, a warhead of larger mass may be used to increase the number of warhead fragments and likewise increase the fragment density uniformly in all directions.

The problem of increasing the on-target fragment density without increasing warhead mass or guidance precision has been attacked with limited success in the prior art. The most significant approach has been the use of fragment mass focusing, a technique in which the location and/or the firing sequence of the charge is arranged to direct fragments in one direction to a greater extent than in other directions. Unfortunately, this results in only a slight improvement in on-target fragment density.

It is therefore an object of the present invention to significantly increase the hit probability for a warhead by increasing the fragment density at the target without increasing warhead size.

It is another object of the present invention to provide a warhead configuration which projects significantly higher fragment densities toward a target without increasing missile size.

SUMMARY OF THE INVENTION

We have discovered that the annular or rounded cross-sectional configuration of the warhead tends to bias the charge-projected fragments in a dispersed pattern which thereby limits the effectiveness of mass focusing. Accordingly, the present invention provides a flat-sided warhead cross-section (e. g. triangular, square, rectangular, or other polygonal shape). Experiment has shown that a flat warhead side is capable of achieving much greater fragment directivity toward the target, resulting in far greater hit probability and permissible miss distances between target and missile. If desired the warhead may be rotated about the longitudinal axis during flight to facilitate compensation for variations in fragment velocities resulting from variations in ambient air density.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

DESCRIPTION OF THE PREFERRED EMBODIMENTS

Figure 1:
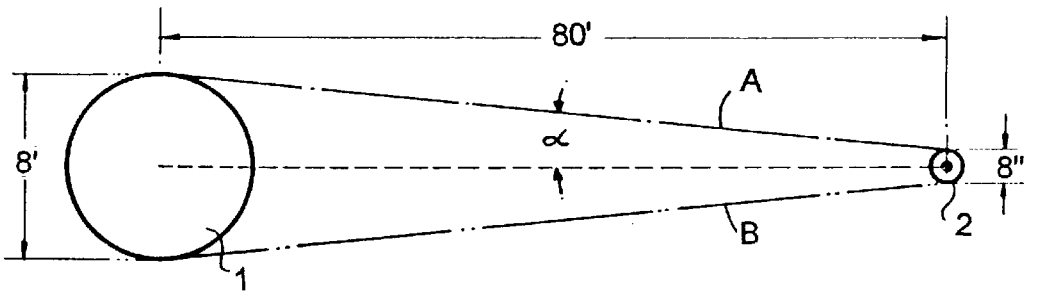
FIG.1 PRIOR ART
FIG. 1 is a diagrammatic illustration of a missile-target encounter for a prior art warhead configuration.
Figure 2:
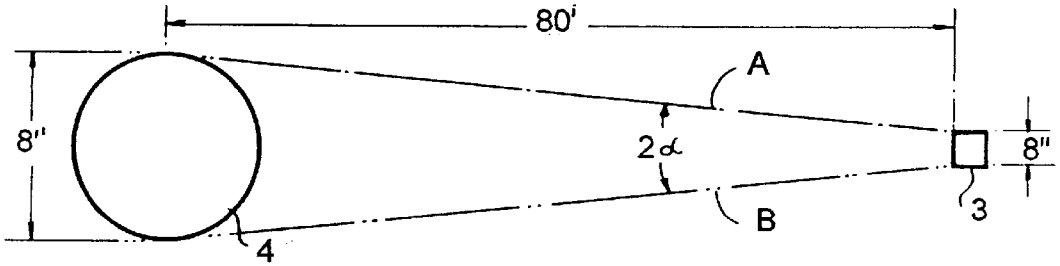
FIG. 2 is a diagrammatic illustration of a missile-target encounter for a warhead configured according to the present invention.

The diagrammatic illustration in FIG. 2 depicts a target 4, identical in size and configuration to target 1 of FIG. 1. A warhead 3 of square cross-section, eight inches on each side, is spaced eighty feet from target 4 at the time of firing. If a flat warhead side is properly positioned relative to the target when the charge is fired, the warhead fragments are biased more toward the target than is the case with the rounded warhead of FIG. 1. Experiment has shown that this flat configurational bias can be augmented by conventional mass focusing techniques to direct substantially all of the fragments of one side within the 2$\alpha$ hit angle. Because of the similar dimensions assumed in the examples of FIGS. 1 and 2, angle 2$\alpha$ is substantially the same (i.e. 5.72°) in FIGS. 1 and 2. However, whereas 25% of the warhead cross-section is directed within the hit angle in FIG. 2, only 1.6% is so directed in FIG. 1. Comparing the on-target effectiveness of the available warhead fragments for the two missile configurations, the improvement provided by the square configurations is $$\frac{25\%}{1.6\%} = 15.6.$$

In other words, an annular warhead would have to be 15.6 times larger to provide the same on-target fragment potential as a square warhead. Of course, the ratio changes if the permissible miss distance changes. For example, for an eight foot target with a miss distance of sixty feet, the improvement provided by the square configuration reduces from 15.6 to 11.5. However, the small permissible miss distance requires greater precision of the missile guidance system, such precision being achieved with considerable increase in cost.

Figure 5:
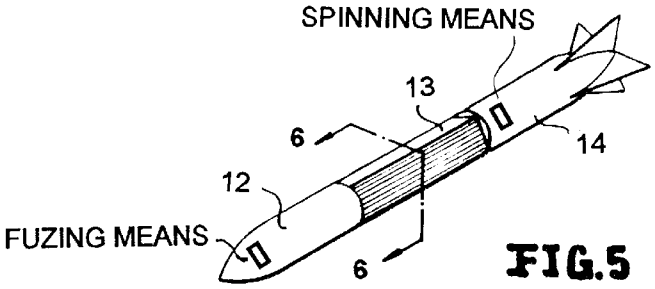
FIG. 5 is a view in perspective of a missile and warhead configuration according to the present invention.
Figure 6:
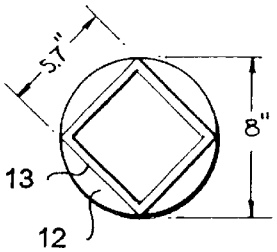
FIG. 6 is a view in section taken along lines 6—6 of FIG. 5.

A typical missile and warhead configuration of the present invention is illustrated in FIG. 5. The warhead 13 is mounted between fore and aft sections 12 and 14, respectively, of the missile. As illustrated in FIG. 6, the warhead 13 has a square cross-section and, as best seen in FIG. 5, is also characterized by four flat rectangular sides. It is important that one of these sides be properly oriented relative to the target at the time of firing so that all of the mass focused fragments of that side can be directed toward the target. Such orientation may be effected by orienting the entire missile, by means of the guidance system, so that one warhead side is directed as desired. Alternatively, and as a preferred embodiment of the invention, the warhead alone may be rotated about the longitudinal axis of the missile by a motor, gas-driven turbine, air turbine, etc. The rotation may be either a slow, controlled positioning of the warhead just prior to firing the charge, or it may be a continuous spinning arrangement wherein the spin speed is controlled to properly position the sides at the time of firing. Spinning of the warhead permits automatic compensation of warhead position for variations in fragment velocities that result from variations in ambient air density.

Figure 3:
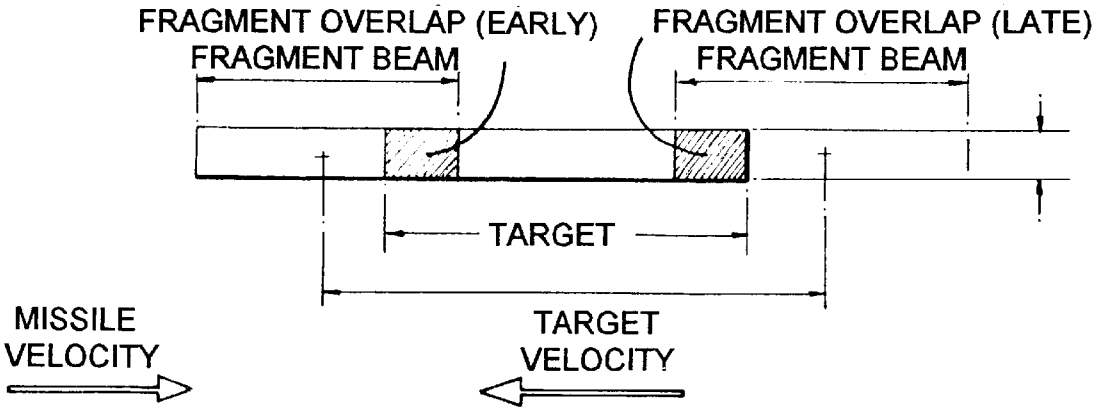
FIG. 3 is a diagrammatic illustration of a missile-target encounter for use in calculating angular spin rates for the warhead of the present invention.
Figure 4:
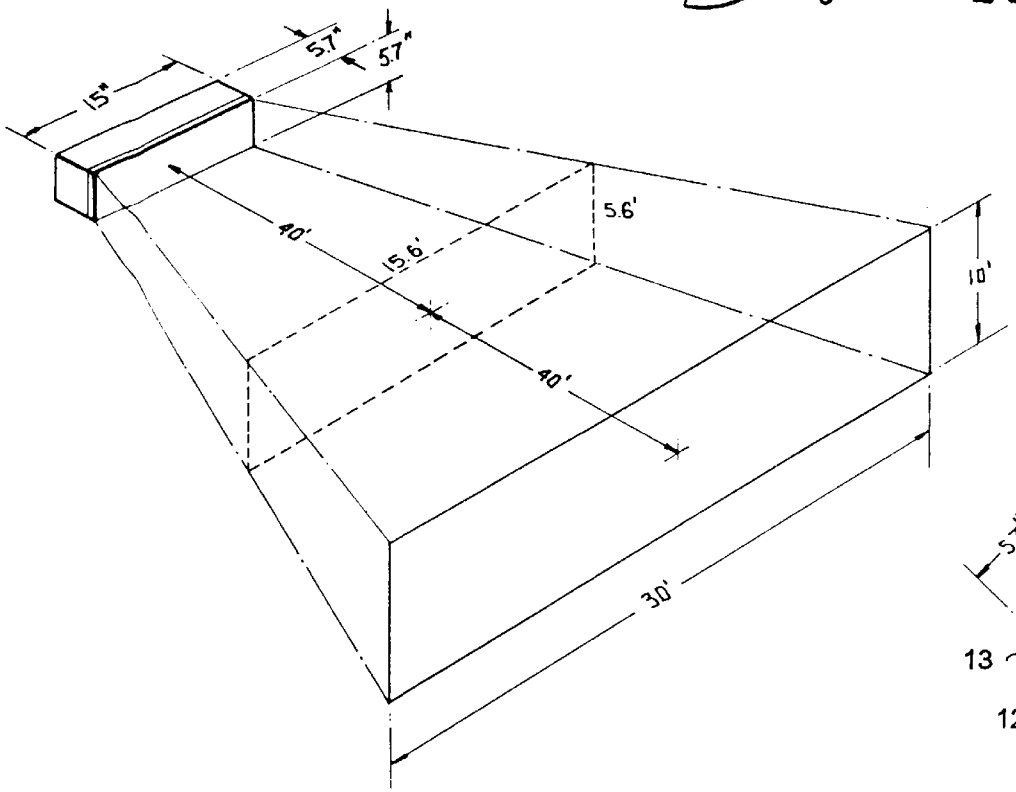
FIG. 4 is a diagram of a focused fragment pattern for a warhead configured according to the present invention.

If a continuous spinning arrangement is employed, the diagrams in FIGS. 3 and 4 are helpful in computing spin velocity requirements. The spin rate is determined by the maximum anticipated closing velocity between target and missile. Using that closing velocity, a spin rate must be devised to assure that one side of the warhead is properly oriented at the time of detonation. Referring to FIG. 4, the fragment pattern for one flat side of a mass focused warhead is illustrated. If we assume that the warhead side is fifteen inches long and has a 5.7 inch square cross-section, the dimensions of the fragment pattern at distances forty and eighty feet from the warhead are illustrated. Assuming a maximum permissible miss distance of eighty feet, it is evident from FIG. 4 that the fragment pattern at that distance is ten feet high by thirty feet wide.

In the diagram of FIG. 3, the fragment pattern width is shown superposed on the target at two different relative positions. In one position the leading one-third of the fragment pattern hits the leading end of the target; in the other position the trailing one-third of the fragment pattern hits the trailing end of the target. These mutual positions of the target and fragment pattern, and any mutual position between these two positions, are considered hits. Assuming the fragment pattern to be thirty feet wide (as per FIG. 4), the length of vulnerable target area to be thirty feet, and a maximum closing velocity of 4000 feet per second between missile and target, then at least one-third (or ten feet) of the fragment pattern will hit the target if the warhead side can be oriented properly in 0.0125 seconds. This is achieved by using a spinning rate of twenty revolutions per second for the warhead, a rate which permits one quadrant of the warhead to rotate 90° during traversal of 50 feet of relative closing distance. Of course, closer miss distances than eighty feet result in a smaller fragment pattern and therefore require faster spin rates. However, this is mitigated to some extent by a greater fragment density existing within the smaller fragment pattern.

Fuzing for the flat-sided, continuously spun warhead is electronically controlled by positional and directional information provided by missile-borne sensors. The data is fed to a servomechanism which mechanically positions a wiper switch to determine the optimum firing position for the warhead. There are four wiper switches connected to the firing circuit, one switch for each side of the warhead. When the fuze circuit determines the proper firing time, a signal is applied to the switches. The warhead is therefore fired upon the next contact of a wiper switch by the servomechanism.

Alternatively, the warhead need not be continuously spun about the missile axis. Rather, the guidance system is programmed to cause the missile to roll to orient a warhead face toward a target. When target lock-on is achieved, the previously stationary warhead is permitted to slowly rotate under control of a servomechanism to keep the warhead side locked onto the target, regardless of further guidance corrections of the overall missile.

It should be noted that the primary inventive concept described herein is the use of a flat-sided warhead. The number of sides is not a limitation, although it should be noted that the percentage of the on-target fragments from the missile drops from 33% with three sides, to 25% with four sides, 20% with five sides, etc.

We wish it to be understood that we do not desire to be limited to the exact details of construction shown and described, for obvious modifications can be made by a person skilled in the art.

We claim:

1. A warhead carried by a missile, said warhead being elongated and having a regular polygonal cross-section throughout its length, so as to form a plurality of elongated flat sides, whereby fragments from said warhead are mass focused in directions perpendicular to each of said flat side faces, the axis of said warhead coinciding with the centerline of said missile;

means to continuously spin said warhead about said axis; and fuzing means to fire said warhead when one of said faces is oriented toward a target.

2. The device of claim 1 wherein said means to continuously spin said warhead includes means to spin said warhead relative to said missile.

3. The warhead according to claim 1 wherein said warhead has four rectangular flat faces and a square cross-section.

* * * * *